US007131313B2

(12) United States Patent
Nakazato

(10) Patent No.: US 7,131,313 B2
(45) Date of Patent: Nov. 7, 2006

(54) BENDING METHOD AND MANDREL OF MULTI-LAYERED PIPE

(75) Inventor: Kazuhiko Nakazato, Koga (JP)

(73) Assignee: Sanoh Industrial Co., Ltd., Koga (JP)

( * ) Notice: Subject to any disclaimer, the term of this patent is extended or adjusted under 35 U.S.C. 154(b) by 337 days.

(21) Appl. No.: 10/643,945

(22) Filed: Aug. 20, 2003

(65) Prior Publication Data

US 2004/0069040 A1 Apr. 15, 2004

(30) Foreign Application Priority Data

Oct. 10, 2002 (JP) ..... 2002-297046

(51) Int. Cl.
*B21D 9/01* (2006.01)
*B21D 9/05* (2006.01)

(52) U.S. Cl. ..... 72/369; 72/149; 72/150; 72/466.2

(58) Field of Classification Search ..... 72/149, 72/150, 153, 466, 466.2, 369, 370.04, 370.05
See application file for complete search history.

(56) References Cited

U.S. PATENT DOCUMENTS 3,859,839 A * 1/1975 Crotti ..... 72/466.2
4,009,601 A * 3/1977 Shimizu ..... 72/369
5,333,481 A * 8/1994 Spath ..... 72/150
5,749,255 A * 5/1998 Arai ..... 72/150
5,937,686 A * 8/1999 Arai ..... 72/150
6,941,787 B1 * 9/2005 Flehmig et al. ..... 72/150

FOREIGN PATENT DOCUMENTS

JP 2001269721 A * 10/2001
WO WO 183130 A1 * 11/2001

* cited by examiner

*Primary Examiner*—Dmitry Suhol
(74) *Attorney, Agent, or Firm*—Posz Law Group, PLC; R. Eugene Varndell, Jr.

(57) ABSTRACT

A method where an inside mandrel is inserted into the inner pipe of the multi-layered pipe, a tubular outside mandrel is inserted into the annular space between the inner pipe and outer pipe, the multi-layered pipe is clamped to a bending die by a clamping die, the multi-layered pipe is held at the rear of a bending portion of the multi-layered pipe by a pressure die and a crease-removing die, and the multi-layered pipe is bent by causing the clamping die to revolve around the bending die. An annular outside mandrel having at least three slits formed in the distal end thereof along generating lines is used as the outside mandrel, and the clamping die is caused to revolve around the bending die with the outside mandrel and inside mandrel protruding toward the distal end of the mutli-layered pipe from a bending start point.

5 Claims, 8 Drawing Sheets

BENDING METHOD AND MANDREL OF MULTI-LAYERED PIPE

BACKGROUND OF THE INVENTION

1. Field of the Invention

The present invention relates to a bending method and a mandrel for a multi-layered pipe including a double pipe, and more specifically to a bending method and a mandrel for a multi-layered pipe wherein bending work is performed with an inside mandrel inserted into an inner pipe of the multi-layered pipe, in which the inner pipe and an outer pipe are disposed concentrically with an appropriate gap therebetween, and an outside mandrel inserted into the gap between the inner pipe and the outer pipe positioned on the outside thereof and the gaps between the outer pipe positioned on the inside and outer pipes positioned on the outside thereof.

2. Description of the Related Art

A double pipe used as an exhaust pipe in an automobile or the like, for example, comprises an inner pipe and an outer pipe disposed with an appropriate gap therebetween, and is bent by a bending operation in a predetermined direction and to a predetermined angle in order to emulate the constitution of the vehicle body, avoid other components, and so on.

This type of double pipe must be bent while maintaining the gap between the inner pipe and outer pipe, and hence the pipe is bent following the insertion of an inside mandrel into the inner pipe and an annular outside mandrel into the gap between the inner pipe and outer pipe (see Japanese Examined Patent Application Publication S55-24971, Japanese Unexamined Patent Application Publication H9-155456, and Japanese Unexamined Patent Application Publication 2001-269721, for example).

In the techniques disclosed in Cited Documents 1 and 2, the outside mandrel is formed as a tube. Hence the outside mandrel cannot change shape and the distal end thereof can only be inserted up to the starting point of the bending portion of the pipe. As a result, a stable double pipe with a constant gap between the inner pipe and outer pipe cannot be obtained at the bending portion.

In the technique disclosed in Cited Document 3, the outside mandrel is constituted by two strip-form elastic plates and bending work is performed with the distal ends of the outside mandrels within the bending range of the pipe. According to this technique, the gap between the inner pipe and outer pipe is maintained. In this technique, the distal end portions of the two outer mandrels must be positioned correctly in an inside R portion and an outside R portion. However, the length of the outside mandrels corresponds to the length of the double pipe, and thus the outside mandrels may contort, causing deviation in the pitch of the outside mandrels such that the positions of the outside mandrels deviate from a predetermined position during the bending work. In particular, when the double pipe is rotated continuously to perform bending work in different directions, the pipe must be twisted, as a result of which the outside mandrels often become contorted.

It is therefore an object of the present invention to provide a bending method and a mandrel for a multi-layered pipe according to which the multi-layered pipe can be bent while maintaining a stable gap between an inner pipe and an outer pipe and between outer pipes even when the pipe is continuously bent into different directions.

SUMMARY OF THE INVENTION

In the bending method for a multi-layered pipe of the present invention, an inside mandrel is inserted into an inner pipe of a multi-layered pipe having one or a plurality of outer pipes disposed concentrically on the outside of the inner pipe, a tubular outside mandrel is inserted into the annular space between the pipe positioned on the inside and the pipe positioned on the outside thereof, and with the mandrels placed inside the multi-layered pipe, the outermost pipe of the multi-layered pipe is clamped to a bending die by a clamping die, the multi-layered pipe is held at the rear of a bending portion of the multi-layered pipe by a pressure die and a crease-removing die, and the multi-layered pipe is bent by causing the clamping die to revolve around the bending die. An annular outside mandrel having at least three slits formed at the distal end thereof along generating lines is used as the outside mandrel, and the clamping die is caused to revolve around the bending die with the distal ends of the outside mandrel and inside mandrel protruding toward the distal end of the pipe from a bending start point.

According to the bending method for a multi-layered pipe of the present invention, the distal end portion of the outside mandrel described above is bent together with the pipe, and thus the gaps between the inner pipe and outer pipe and between the outer pipes are maintained securely at the bending portion of the pipe. Even when the pipe is rotated continuously to bend the pipe into different directions, the tongue pieces of the outside mandrel, which are divided and defined by the slits, are supported by adjacent tongue pieces and therefore prevented from contorting and deforming, and hence the outside mandrel can be maintained in a fixed position without contorting.

The tongue pieces of the outside mandrel, which are divided by the slits, are bent together with the pipe, and therefore preferably have an elastic quality. Further, the distal end parts of the outside mandrel, including the tongue pieces, slide between the pipe positioned on the inside and the pipes positioned on the outside thereof, and therefore preferably have low friction resistance and high wear resistance. Ultra high molecular weight polyethylene, MC nylon, polyacetate, and so on can be cited as materials used to form such an outside mandrel.

The number of slits in the outside mandrel and the length of these slits are appropriately selected such that the tongue pieces divided by the slits can change shape easily, and such that when the outside mandrel is inserted into the gap between the pipe positioned on the inside and the pipe positioned on the outside, the tongue pieces are strong enough not to buckle. Accordingly, the number of slits is preferably three to twelve, and more preferably six to ten. The slits are formed by making incisions in an orthogonal cross section to the central axis in a radial form or such that the slits are parallel to one another. The slits may also be disposed in an orthogonal cross section to the central axis of the pipe at equal intervals around the entire circumference or partially, for example only in the two opposing arc parts.

The width of the slits in the outside mandrel is preferably as small as possible to prevent contortion of the tongue pieces caused by adjacent tongue pieces locking together. Further, the outside mandrel is preferably inserted such that the distal end thereof protrudes toward the distal end of the pipe from the bending start point, and even more preferably such that the distal end thereof protrudes further toward the distal end of the pipe than an anticipated bending range of the pipe. The insertion position of the inside mandrel is preferably similar to that of the outside mandrel. However, when formed from a material with little elasticity, for example a metal, then the inside mandrel is preferably positioned to the rear of the outside mandrel.

Here, the bending start point is the position at which bending of the pipe begins, and the bending range is the range of the pipe that is bent, or in other words the range of the arc portions.

Further, in the bending method for a multi-layered pipe according to the present invention, the inner pipe is preferably pushed in the direction of the distal end of the inner pipe when the bending die is to be revolved.

In so doing, deformation of the inner pipe is precipitated and the gap between the inner pipe and outer pipe can be maintained with high precision.

DESCRIPTION OF THE PREFERRED EMBODIMENTS

Figure 1:
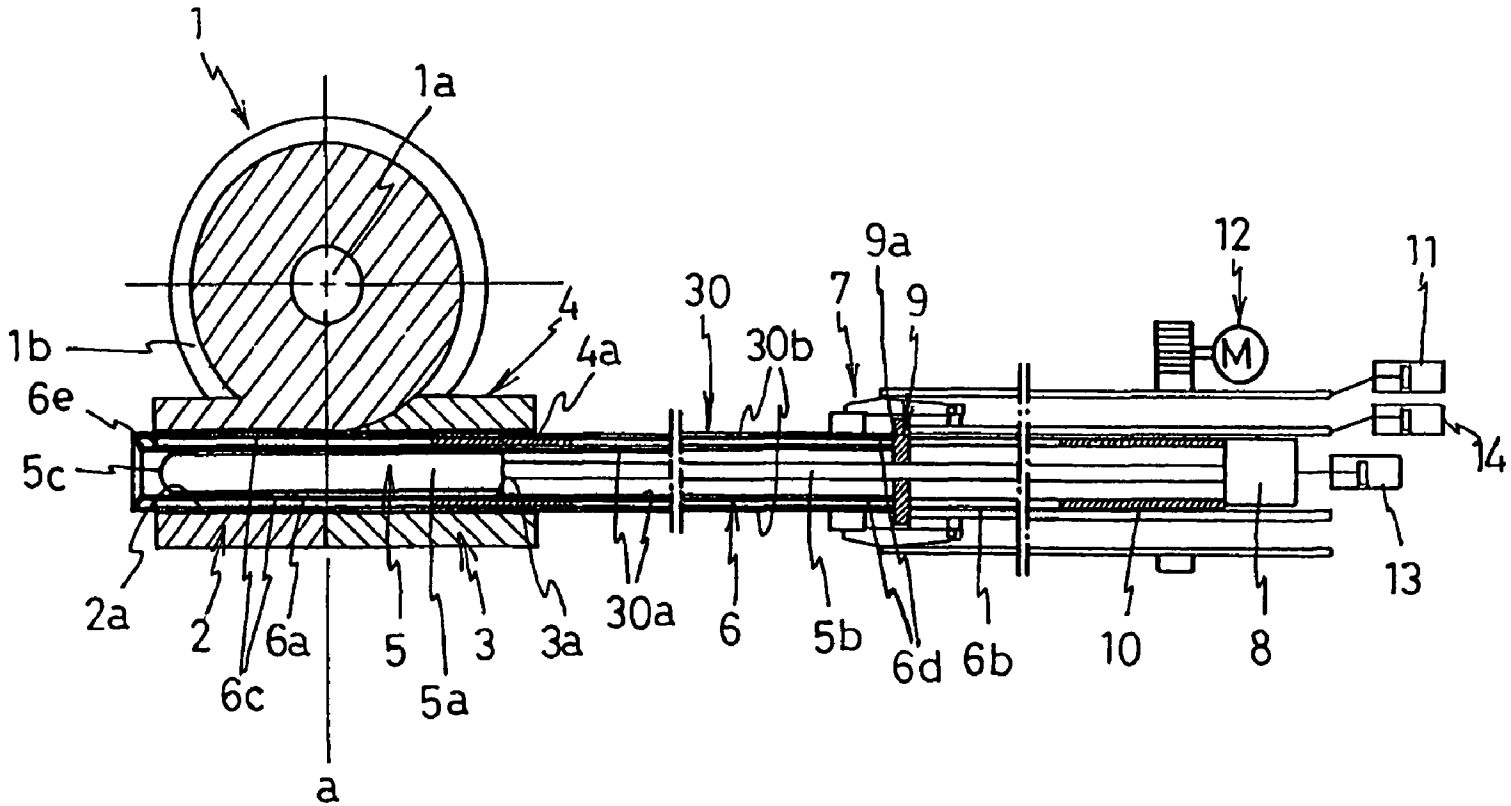
FIG. 1 is a schematic sectional view showing the initial state of an example of the multi-layered pipe bending method according to the present invention applied to a double pipe.

The present invention will be described below on the basis of the embodiments illustrated in the drawings.

Figure 2:
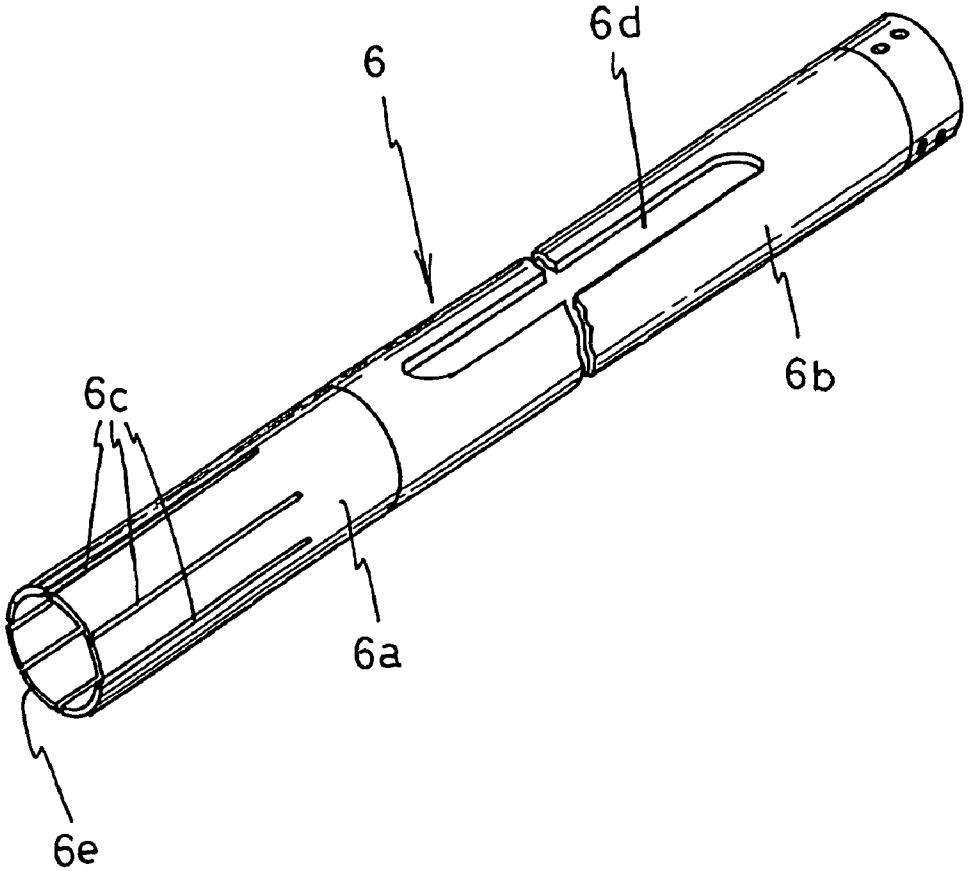
FIG. 2 is a perspective view showing an outside mandrel used in the multi-layered pipe bending method according to the present invention.

FIG. 1 shows in outline a bending device for a double pipe serving as a bending device for implementing the multi-layered pipe bending method according to the present invention, FIG. 2 shows an outside mandrel used in the bending device, and FIGS. 3 through 7 show a processing procedure.

A double pipe 30 which is processed by this bending device is constituted by an inner pipe 30*a* and an outer pipe 30*b* disposed concentrically with the inner pipe 30*a* on the outside thereof and with a gap therebetween. The inner pipe 30*a* and outer pipe 30*b* are joined integrally at the distal end thereof.

The bending device comprises a bending die 1, a clamping die 2, a pressure die 3, and a crease-removing die 4.

The bending die 1 is disposed rotatably about a shaft 1*a*, and comprises a groove 1*b* on the peripheral surface thereof for accommodating the pipe 30. The clamping die 2 is disposed movably (revolvably) around the peripheral surface of the bending die 1 about the shaft 1*a* of the bending die 1, and comprises a groove 2*a* which opposes the groove 1*b* of the bending die 1. The pressure die 3 and crease-removing die 4 are disposed opposite each other so as to sandwich the pipe 30, and comprise grooves 3*a*, 4*a* on the respective opposing surfaces thereof for accommodating the pipe 30. The pressure die 3 is disposed movably parallel to the pipe 30.

The bending device also comprises an inside mandrel 5 to be inserted into the inner pipe 30*a* and an outside mandrel 6 to be inserted into the gap between the inner pipe 30*a* and outer pipe 30*b*.

The inside mandrel 5 comprises a columnar portion 5*a* with a fusiform distal end and a rod 5*b* which extends rearward from the other end of the columnar portion 5*a*. The columnar portion 5*a* is formed from a synthetic resin material having such characteristics as high elasticity, low frictional resistance, high wear resistance, and high impact resistance, for example ultra high molecular weight polyethylene, MC nylon, or polyacetate, and the rod 5*b* is formed from a metallic material which is high in rigidity such as iron.

As shown in FIG. 2, the outside mandrel 6 is formed in tubular form. A distal end portion 6*a* of the outside mandrel 6 is formed from a synthetic resin material having characteristics such as high elasticity, low frictional resistance, high wear resistance, and high impact resistance, for example ultra high molecular weight polyethylene, MC nylon, or polyacetate, and a remaining rear portion 6*b* is formed from a metallic material which is high in rigidity such as iron. At least three (eight in this embodiment) slits 6*c* are formed in a generating line direction in the distal end portion 6*a*, and an elongated hole 6*d* is formed along the generating line in the rear portion 6*b*.

The bending device further comprises a pipe-holding chuck 7 for holding the outer pipe 30*b* and a mandrel-holding chuck 8 for holding the outside mandrel 6 and inside mandrel 5 by the rear ends thereof. A pressing block 9 which is engaged with the rod portion 5*b* of the inside mandrel 5 and comprises a protrusion 9*a* which protrudes onto the peripheral surface and extends outward through the elongated hole 6*d* of the outside mandrel 6, and tubular pushing means 10 which push the pressing block 9 in the direction of the distal end of the pipe 30 are also provided.

The pipe-holding chuck 7 is opened and closed by an actuator such as a hydraulic cylinder 11, and is rotated by an actuator such as a motor 12. The mandrel-holding chuck 8 is moved in the axial direction of the inside mandrel 5 and outside mandrel 6 by an actuator such as a hydraulic cylinder 13. The pushing means 10 apply a predetermined pressure to the inner pipe 30*a* through the pressing block 9 using an actuator such as a pneumatic cylinder 14.

The double pipe is bent using the bending device described above in the following manner.

As shown in FIG. 1, first the inside mandrel 5 is inserted into the inner pipe 30*a* and the outside mandrel 6 is inserted into the gap between the inner pipe 30*a* and outer pipe 30*b*. In this state, the pipe 30 is inserted between the pressure die 3 and crease-removing die 4 such that the part of the pipe 30 which is to be bent is positioned between the bending die 1 and clamping die 2. The clamping die 2 is moved in the direction of the bending die 1 such that the pipe 30 is clamped by the clamping die 2 and bending die 1.

At this time, a distal end 5*c* of the inside mandrel 5 and a distal end 6*e* of the outside mandrel 6 are positioned so as to protrude from a bending start point a of the pipe 30 further toward the distal end of the pipe 30 than an anticipated bending range α.

The inside mandrel 5 and outside mandrel 6 are maintained in this position by the chuck 8, and the outer pipe 30*b* remains released from the chuck 7.

Figure 3:
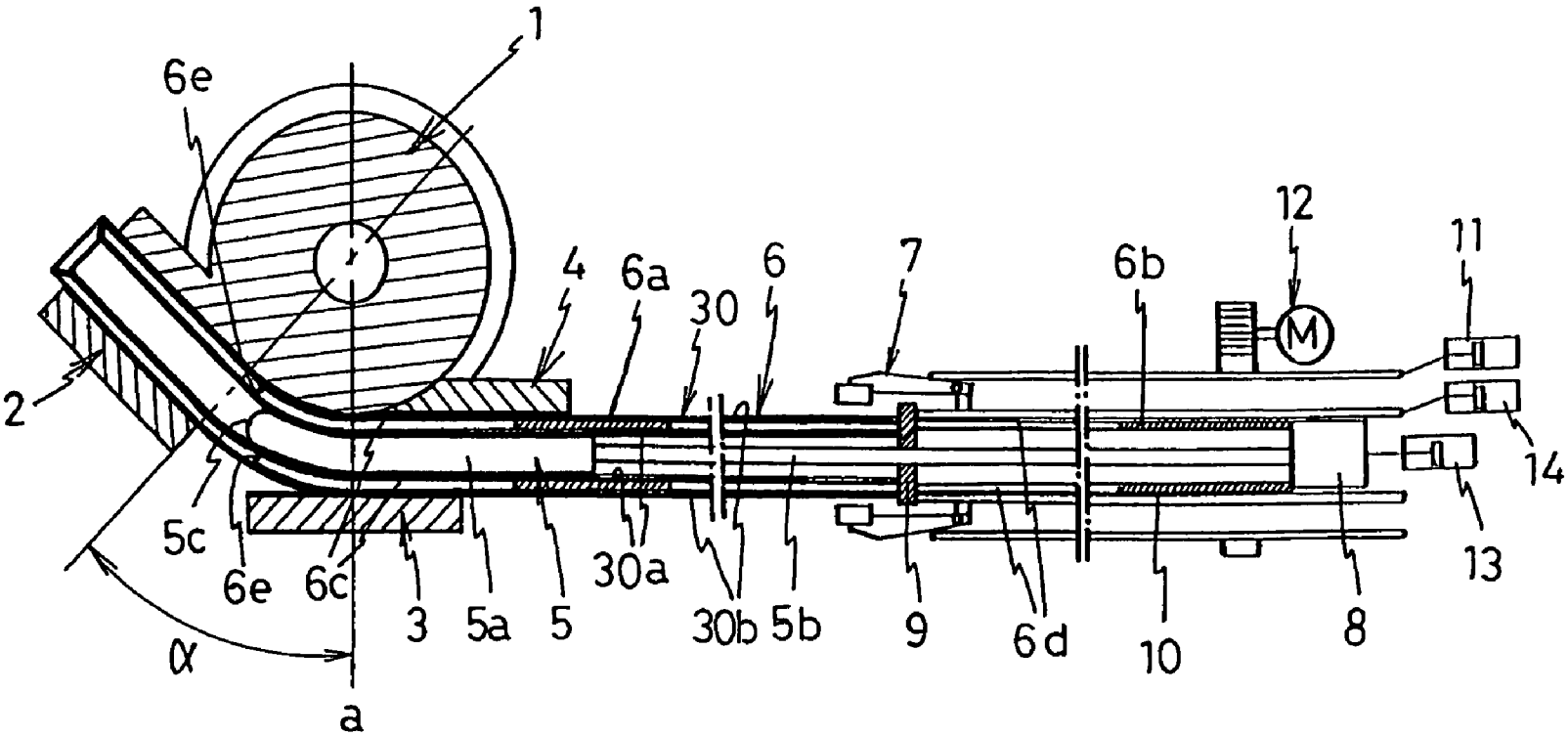
FIG. 3 is a schematic sectional view showing the state following that of FIG. 1 of the example of the multi-layered pipe bending method according to the present invention applied to a double pipe.

In this state, as shown in FIG. 3, the clamping die 2 is caused to revolve around the bending die 1 such that the pipe 30 is bent. At this time, only the inner pipe 30*a* is pushed in the distal end direction by the pushing means 10.

Figure 4:
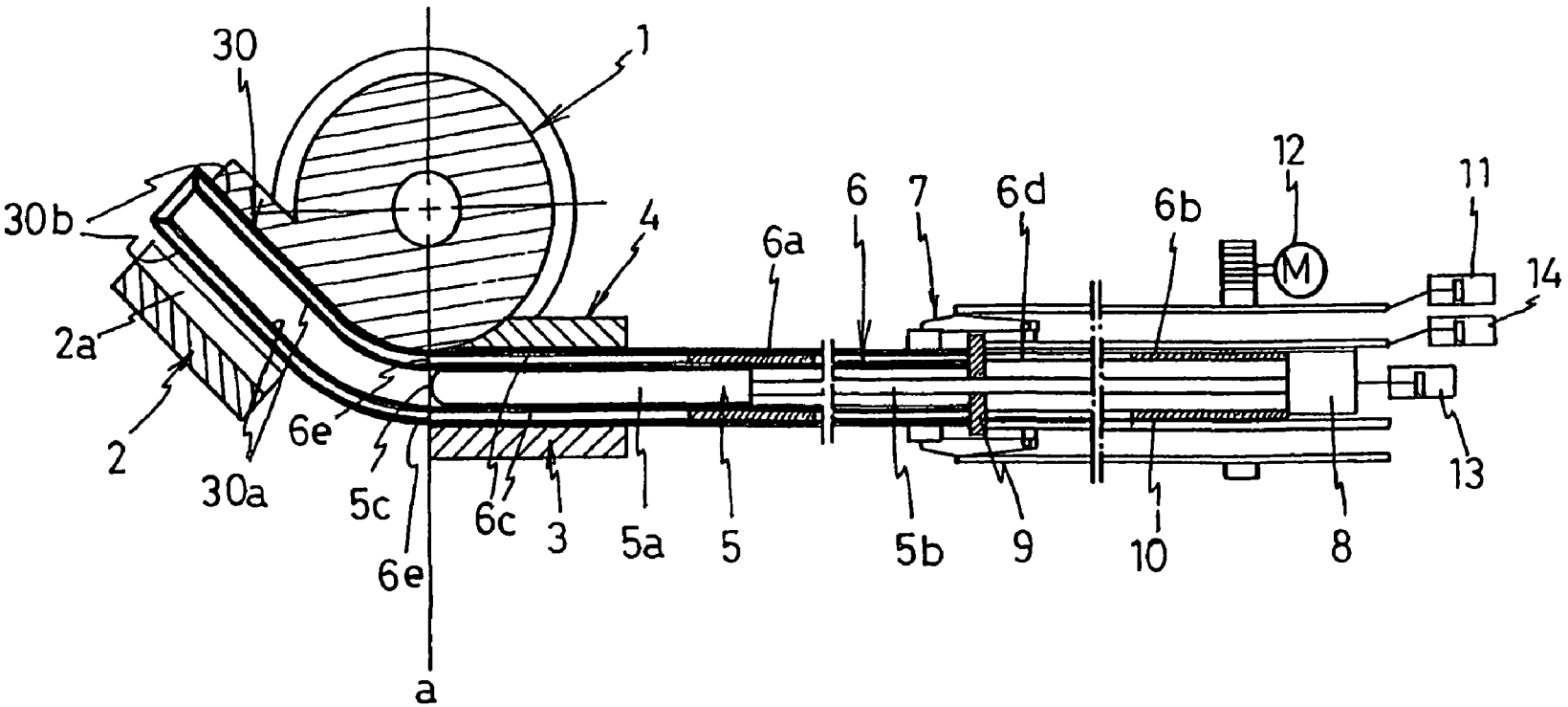
FIG. 4 is a schematic sectional view showing the state following that of FIG. 3 of the example of the multi-layered pipe bending method according to the present invention applied to a double pipe.

If the bending work is thus completed, the outer pipe 30*b* is held by the chuck 7, the inside mandrel 5 and outside mandrel 6 are moved back by a predetermined amount, and the clamping die 2 is released, as shown in FIG. 4.

Figure 5:
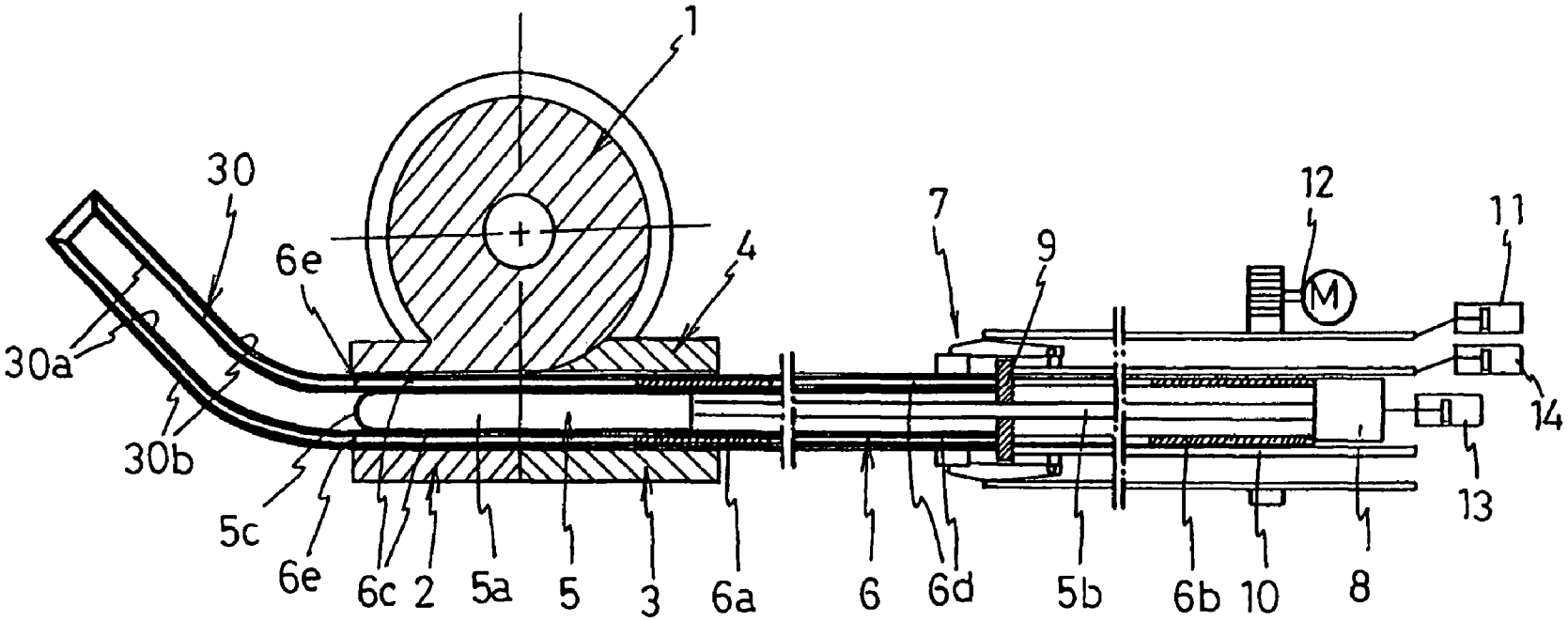
FIG. 5 is a schematic sectional view showing the state following that of FIG. 4 of the example of the multi-layered pipe bending method according to the present invention applied to a double pipe.
Figure 6:
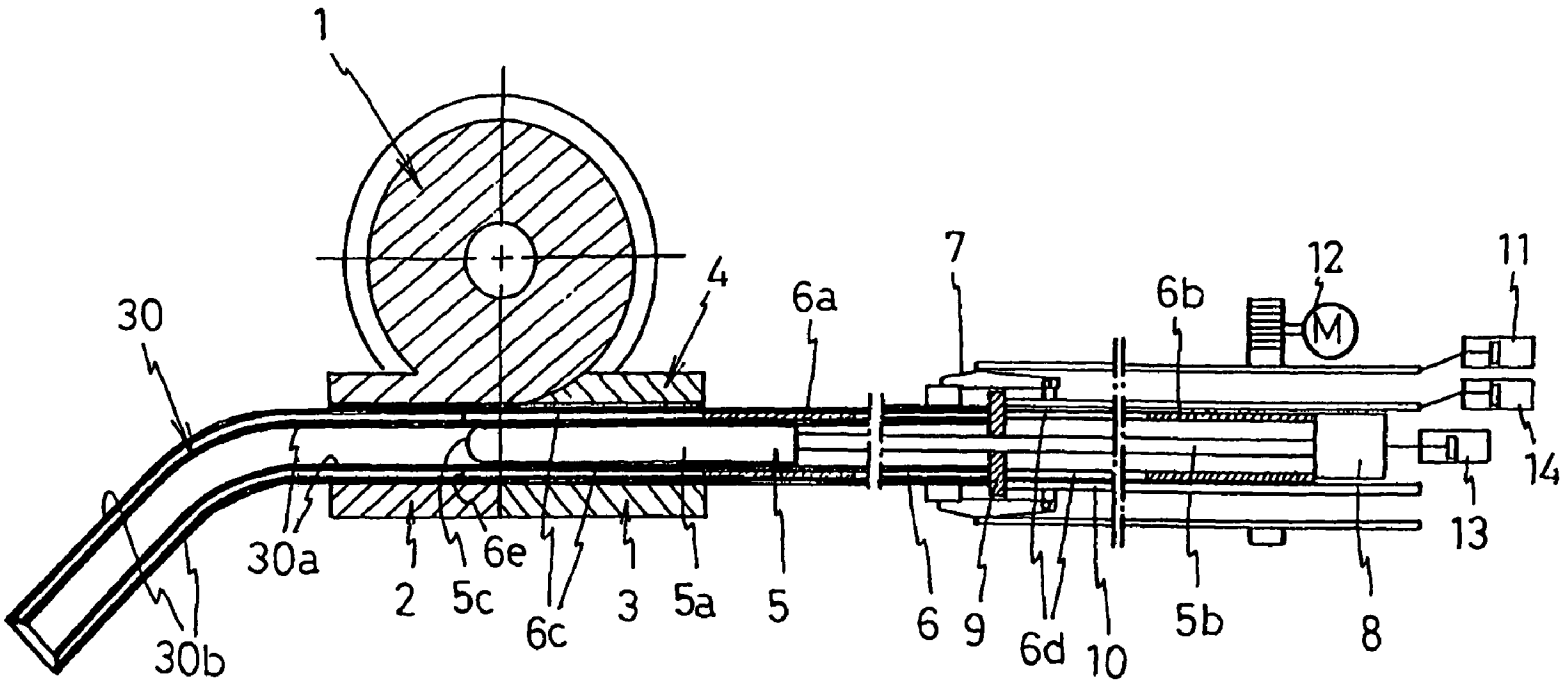
FIG. 6 is a schematic sectional view showing the state following that of FIG. 5 of the example of the multi-layered pipe bending method according to the present invention applied to a double pipe.

Next, as shown in FIG. 5, the outer pipe 30*b* is moved to the next bending position by the chuck 7. If the bending direction is to be altered at this time, a turning operation is performed by the motor 12 or the like to position the pipe 30 in a desired attitude, as shown in FIG. 6. The bending die 1 and clamping die 2 are then returned to their original positions.

Figure 7:
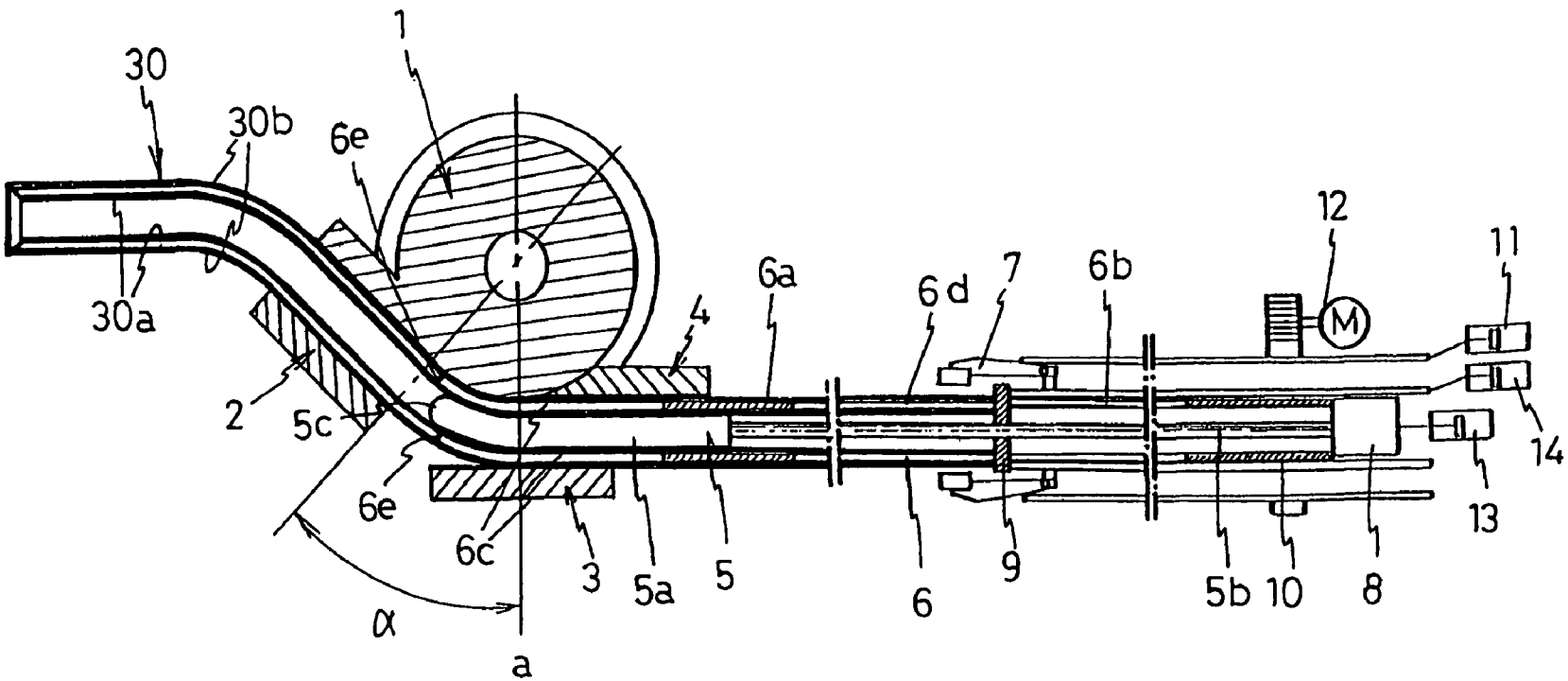
FIG. 7 is a schematic sectional view showing the state following that of FIG. 6 of the example of the multi-layered pipe bending method according to the present invention applied to a double pipe.

Subsequent bending work is then performed as shown in FIG. 7 by repeating the operation described above.

Note that in this embodiment, an example was described in which the pipe 30 is bent in different directions on the same plane (two-dimensionally), but the pipe 30 may of course be bent in a three-dimensional direction.

Also in this embodiment, a bending method for a double pipe was described, but the present invention is not limited to a double pipe and may of course be applied to a multi-layered pipe which exceeds a double structure.

In this case, outside mandrels are preferably inserted into each of the gaps between the inside outer pipe and the outer pipes positioned on the outside thereof.

Figure 8:
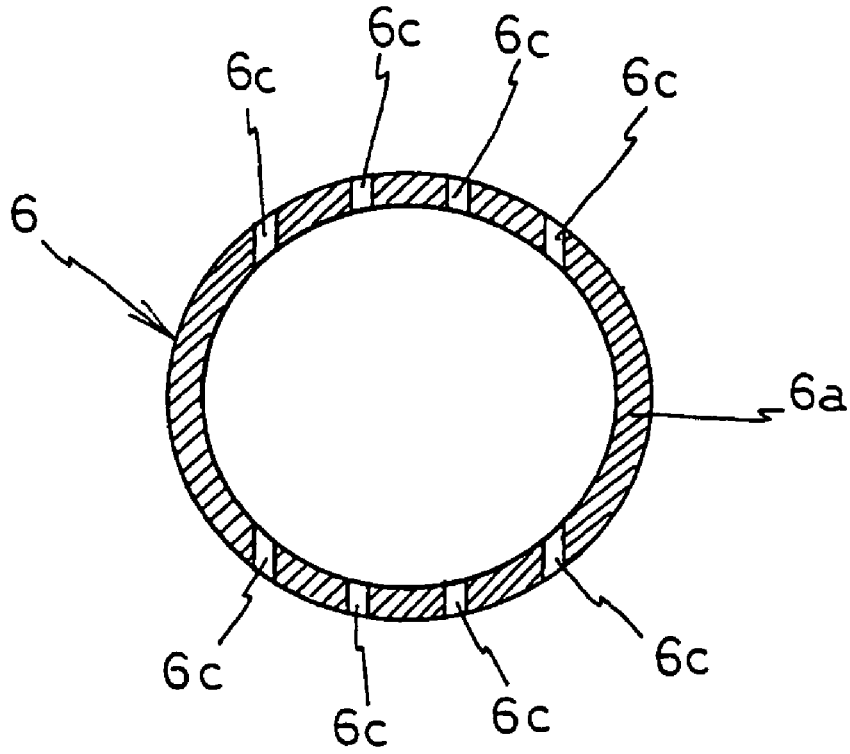
FIG. 8 is a sectional view showing another embodiment of the mandrel according to the present invention.

Also in this embodiment, the slits 6*c* in the outside mandrel 6 are formed radially, but may be disposed parallel to one another rather than radially, as shown in FIG. 8.

The characteristics of the materials used for the columnar portion 5*a* of the inside mandrel 5 and the distal end portion 6*a* of the outside mandrel 6 in the embodiment described above are displayed in Table 1.

TABLE 1

| TEST METHOD ASTM | | RESIN NEME UNIT | ULTRA HIGH MOLECULAR WEIGHT POLYETHYLENE | MC NYLON | POLYACETATE |
|---|---|---|---|---|---|
| TENSILE STRENGTH | D-638 | Mpa | 44 | 66~98 | 60 |
| TENSILE ELONGATION | D-638 | % | 350 | 10~50 | 75 |
| MODULUS OF BENDING ELASTICITY | D-790 | Mpa | 2450 | 2940~3620 | 2580 |
| IZOD IMPACT RESISTANCE | D-254 | J/m | DOES NOT BREAK | 50 | 58 |
| FRICTION COEFFICIENT | D-1894 | — | 0.09 | — | 0.15 |

As described above, according to the bending method for a multi-layered pipe of the present invention, an outside mandrel having a tubular distal end portion divided by at least three slits is used, and thus the distal end portion bends together with the pipe such that the gaps between the inner pipe and outer pipe and between outer pipes are securely maintained in the bending portion of the pipe. Even when the pipe is rotated continuously to bend the pipe in different directions, the distal end parts of the outside mandrel, which are divided by the slits, are supported by adjacent distal end parts, and hence the outside mandrel can be maintained in a fixed position without contorting.

As a result, the multi-layered pipe may be bent while maintaining stable gaps between the inner pipe and outer pipe and between outer pipes even when the pipe is bent continuously into different directions.

Also according to the bending method for a multi-layered pipe of the present invention, the inner pipe is pushed in the direction of the distal end of the inner pipe when the clamping die is caused to revolve, thereby precipitating deformation of the inner pipe and maintaining the gap between the inner pipe and outer pipe with high precision.

What is claimed is:

1. A bending method for a multi-layered pipe having one or a plurality of outer pipes disposed concentrically on an outside of an inner pipe, in which an inside mandrel is inserted into said inner pipe of said multi-layered pipe, a tubular outside mandrel is inserted into the annular space between said inner pipe positioned on the inside and the outer pipe positioned on the outside thereof, and with the mandrels placed inside said multi-layered pipe, the outermost pipe of said multi-layered pipe is clamped to a bending die by a clamping die, said multi-layered pipe is held at a rear of a bending portion of said multi-layered pipe by a pressure die and a crease-removing die, and said multi-layered pipe is bent by causing said clamping die to revolve around said bending die while said inner pipe is independently pushed in the direction of the distal end of said inner pipe, wherein an annular outside mandrel having at least three slits formed in the distal end thereof along generating lines is used as said outside mandrel; the distal end portion of the outside mandrel is one of an ultra high molecular weight polyethylene, MC nylon, and polyacetate; and said clamping die is caused to revolve around said bending die with the distal ends of said outside mandrel and said inside mandrel being positioned so as to protrude toward the distal end of said multi-layered pipe from a bending start point.

2. The bending method for a multi-layered pipe according to claim 1, wherein the distal end of said outside mandrel is positioned so as to protrude further toward the distal end of said multi-layered pipe than an anticipated bending range.

3. The bending method for a multi-layered pipe according to claim 2, wherein the distal end portion of the inside mandrel is formed from a material with a high elasticity.

4. The bending method for a multi-layered pipe according to claim 1, wherein the distal end portion of the inside mandrel is formed from a material with a high elasticity.

5. The bending method for a multi-layered pipe according to claim 4, wherein one of ultra high molecular weight polyethylene, MC nylon, and polyacetate is used as the material for forming said distal end portion of the inside mandrel.

* * * * *